US010076925B2

(12) United States Patent
Tani

(10) Patent No.: US 10,076,925 B2
(45) Date of Patent: Sep. 18, 2018

(54) FEEDING PENCIL

(71) Applicant: TOKIWA CORPORATION, Gifu (JP)

(72) Inventor: Yoshikazu Tani, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 40 days.

(21) Appl. No.: 15/354,258

(22) Filed: Nov. 17, 2016

(65) Prior Publication Data

US 2017/0151826 A1 Jun. 1, 2017

(30) Foreign Application Priority Data

Nov. 30, 2015 (JP) ..... 2015-233491

(51) Int. Cl.

| | |
|---|---|
| ***B43K 21/18*** | (2006.01) |
| ***B43K 27/04*** | (2006.01) |
| ***B43K 21/08*** | (2006.01) |
| ***B43K 24/12*** | (2006.01) |
| ***A45D 40/20*** | (2006.01) |
| ***B43K 27/08*** | (2006.01) |
| ***A45D 40/24*** | (2006.01) |

(52) U.S. Cl.

CPC ..... *B43K 27/04* (2013.01); *A45D 40/205* (2013.01); *A45D 40/24* (2013.01); *B43K 21/08* (2013.01); *B43K 24/12* (2013.01); *B43K 27/08* (2013.01); *A45D 2040/207* (2013.01); *B43K 21/18* (2013.01)

(58) Field of Classification Search

CPC ..... B43K 21/003; B43K 21/16; B43K 21/18; B43K 24/18; B43K 27/04

USPC ..... 401/66

See application file for complete search history.

(56) References Cited

U.S. PATENT DOCUMENTS

| | | | |
|---|---|---|---|
| 8,950,963 | B2 | 2/2015 | Pechko et al. |
| 2006/0222439 | A1 | 10/2006 | Tani |
| 2015/0030370 | A1 | 1/2015 | Tani |

(Continued)

FOREIGN PATENT DOCUMENTS

| | | |
|---|---|---|
| CN | 104337210 | 2/2015 |
| CN | 105270036 | 1/2016 |
| JP | S55-083387 | 6/1980 |

(Continued)

OTHER PUBLICATIONS

U.S. Appl. No. 15/354,294 to TANI, filed Nov. 17, 2016.

(Continued)

*Primary Examiner* — David Walczak
*Assistant Examiner* — Joshua Wiljanen
(74) *Attorney, Agent, or Firm* — Greenblum & Bernstein, P.L.C.

(57) ABSTRACT

A feeding pencil includes a main body, a leading tube, a middle tube, and a ratchet mechanism. The middle tube is engaged to the leading tube to be relatively rotatable. A relative rotation between the leading tube and the main body in one direction moves a drawing material forward. The ratchet mechanism allows the relative rotation between the leading tube and the main body in the one direction, and regulates the relative rotation in another direction. The ratchet mechanism includes an elastic projecting part and a concave-convex part. The concave-convex part engages with the elastic projecting part to be movable in an axial direction and rotatable. A protrusion disposed at a center tube removably engages with an annular convex part disposed at an outer surface of the leading tube in the axial direction.

2 Claims, 16 Drawing Sheets

(56) References Cited

U.S. PATENT DOCUMENTS

2015/0313343 A1 11/2015 Weibl, Sr.

FOREIGN PATENT DOCUMENTS

| | | |
|---|---|---|
| JP | 63-103778 | 7/1988 |
| JP | 05-39418 | 5/1993 |
| JP | 2002-119330 | 4/2002 |
| JP | 3088498 | 9/2002 |
| JP | 2003-52451 | 2/2003 |
| JP | 2015-24081 | 2/2015 |
| JP | 2015-134107 | 7/2015 |
| KR | 1999-004610 | 2/1999 |
| KR | 2000-0021233 | 12/2000 |

OTHER PUBLICATIONS

Office Action issued in China Counterpart Patent Appl. No. 201611027265.6, dated Apr. 23, 2018.
Office Action issued in Korea Counterpart Patent Application No. 10-2018-0007188, dated Apr. 18, 2018.
Official Action received in KR Patent Application No. 10-2016-0158268, dated Jun. 27, 2018.
Official Action received in KR Patent Application No. 10-2018-0007188, dated Jun. 29, 2018.

FEEDING PENCIL

TECHNICAL FIELD

The present disclosure relates to a feeding pencil used by extruding a drawing material.

BACKGROUND ART

Conventionally, there has been known a feeding pencil disclosed in, for example, Japanese Unexamined Patent Application Publication No. 2015-024081. This patent publication discloses an applying material extruding container that appropriately extrudes a filled applying material by user's operation. This applying material extruding container includes a filling member, a control cylinder, a movable body, and a screw cylinder. The filling member internally includes a filling region filled with the applying material. The control cylinder is coupled to a rear end part of the filling member so as to be relatively rotatable with respect to the filling member. The relative rotation of the filling member and the control cylinder moves the movable body in an axial direction. The screw cylinder ensures the movement of the movable body by this relative rotation.

With the above-described applying material extruding container, the screw cylinder includes a rear end tube. The control cylinder includes an internal tubular part internally inserted into the rear end tube. On an outer circumferential surface of the internal tubular part, a protrusion on one side that protrudes outwardly in a radial direction is provided. On an inner circumferential surface of the rear end tube, a protrusion on the other side that protrudes inwardly in the radial direction and that engages with the protrusion on one side in a rotation direction is provided. The protrusion on the other side has elasticity in the radial direction by cutouts therearound. In a state where the internal tubular part has not yet been inserted to the inside of the rear end tube, an inner diameter of a tip end of the other protrusion is smaller than an outer diameter of the outer circumferential surface of the rear end tube. In a state where the internal tubular part is inserted to the inside, the other protrusion is always brought into abutment with the outer circumferential surface of the rear end tube.

CITATION LIST

Patent Literature

Patent Literature 1: Japanese Unexamined Patent Application Publication No. 2015-024081

SUMMARY OF INVENTION

Technical Problem

Recently, various kinds of requests have been increased for a feeding pencil like the above-described applying material extruding container. The feeding pencil that can be easily decomposed and whose internal components can be easily exchanged by a user has been desired. That is, in case of a failure in the internal component or a similar failure, the feeding pencil decomposed to ensure the easy exchange of this component by the user has been desired.

An object of the present disclosure is to provide a feeding pencil that can be easily decomposed and whose internal components can be easily exchanged.

Solution to Problem

To solve the above-described problems, a feeding pencil according to the present disclosure includes a tubular main body, a leading tube, a middle tube and a ratchet mechanism. The leading is tube configured to be rotatably engaged with the main body. The middle tube has a tube portion configured to be inserted into a rear side portion of the leading tube. The middle tube is positioned between the leading tube and the main body and is configured to be rotatably engaged with the leading tube. The relative rotation between the leading tube and the main body in one direction moves a drawing material forward inside of the leading tube. The ratchet mechanism is configured to allow the relative rotation between the leading tube and the main body in one direction. The ratchet mechanism is configured to regulate the relative rotation in other direction opposite from the one direction. The ratchet mechanism includes an elastic projecting part and a concave-convex part, the elastic projecting part projecting from an outer surface on the tube portion, the elastic projecting part having elasticity in a radial direction, the concave-convex part being disposed on an inner surface of the leading tube, the concave-convex part being configured to engage with the elastic projecting part to be movable in an axial direction and rotatable. A projection disposed at any one of the outer surface of the tube portion and the inner surface of the leading tube is configured to removably engage with an annular convex part disposed at another in the axial direction.

This feeding pencil includes the ratchet mechanism that allows the relative rotation between the leading tube and the main body in the one direction and regulates the relative rotation in the other direction. The ratchet mechanism includes the elastic projecting part, which projects from the outer surface on the tube portion of the middle tube, and the concave-convex part on the inner surface of the leading tube. In this ratchet mechanism, the concave-convex part on the inner surface of the leading tube is movable with respect to the elastic projecting part on the outer surface of the tube portion in the axial direction. The protrusion disposed at any one of the outer surface of the tube portion and the inner surface on the leading tube removably engages with the annular convex part, which is disposed at the other, in the axial direction. Therefore, the leading tube can be removably attachable to the middle tube in the axial direction, thereby ensuring easy decomposition by removing the leading tube from the middle tube. Accordingly, in case of a failure in the internal component or a similar case, the user can remove the leading tube and easily exchange the internal component.

The feeding pencil may be configured as follows. The plurality of drawing materials are stored in the leading tube. The plurality of sliding parts coupled to the plurality of drawing materials respectively are disposed. The plurality of sliding parts are slidable with respect to the main body by a predetermined amount. One arbitrary sliding part, out of the plurality of sliding parts, moves forward by a predetermined amount with respect to the main body, whereby the drawing material coupled with the one arbitrary sliding part is exposed from the leading tube, and in this state, the leading tube and the main body are relatively rotated in one direction, which allows the drawing material to move forward. In this case, the plurality of drawing materials can be stored in a feeding pencil, and the one any given drawing material can be moved forward for use.

Advantageous Effects of Invention

According to the present disclosure, the feeding pencil can be easily decomposed, and the internal component of the feeding pencil can be easily exchanged.

DESCRIPTION OF EMBODIMENTS

The following describes embodiments of the present disclosure with reference to the drawings. In the following description, the identical or corresponding elements are identified with the identical symbols, and their description will not be repeated.

Figure 1:
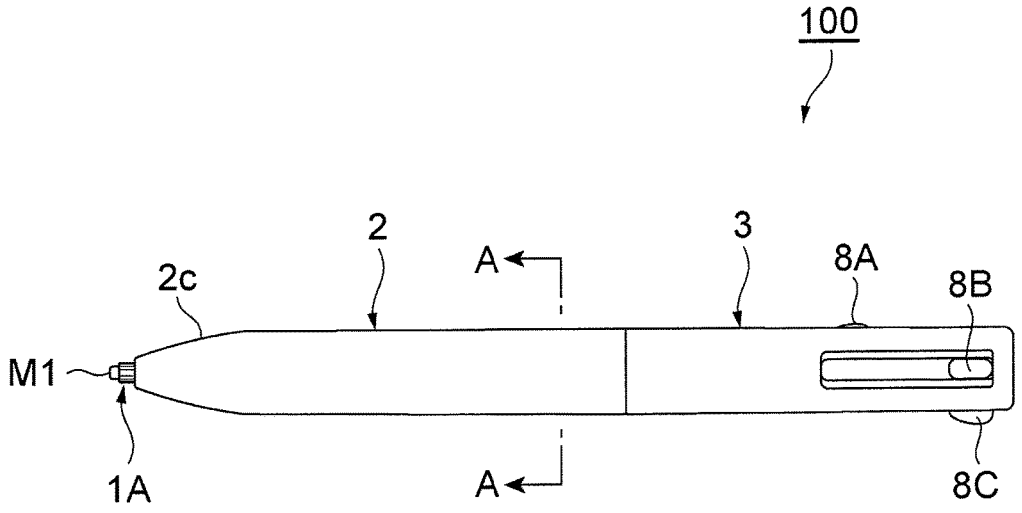
FIG. 1 is a side view illustrating a feeding pencil according to an embodiment.
Figure 2:
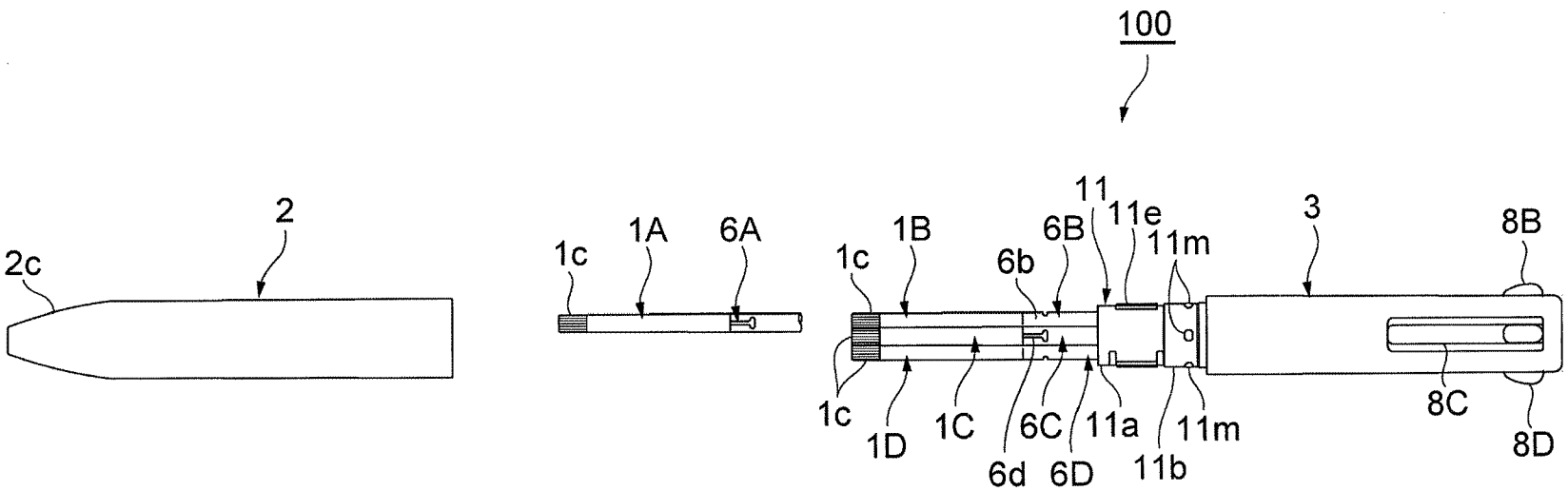
FIG. 2 is a side view illustrating the feeding pencil in FIG. 1 from which a leading tube and one cartridge are removed.
Figure 3:
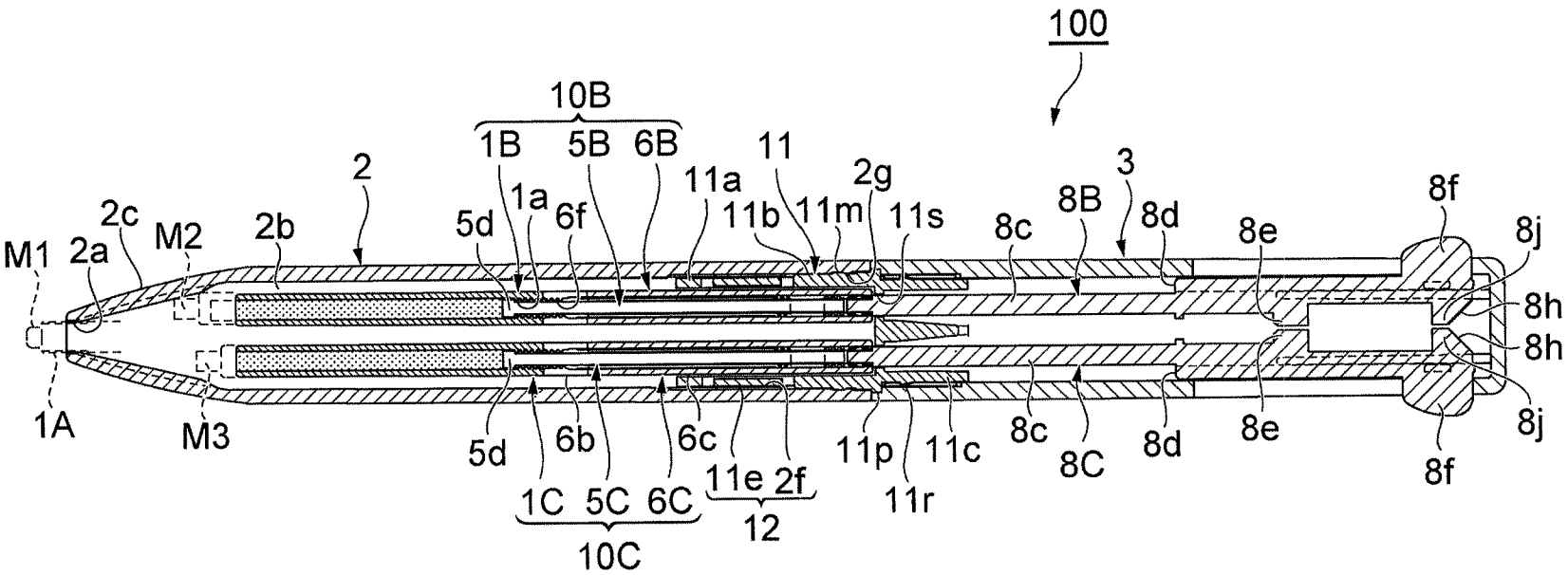
FIG. 3 is a vertical cross-sectional view illustrating the feeding pencil in FIG. 1.

FIG. 1 is a side view of a feeding pencil according to the embodiment. FIG. 2 is a side view illustrating the feeding pencil in FIG. 1 from which one cartridge is removed. FIG. 3 is a vertical cross-sectional view illustrating the feeding pencil in FIG. 1. As shown in FIG. 1 to FIG. 3, a feeding pencil 100 according to the present embodiment is a variety pencil that appropriately discharges (extrudes) any one of a plurality of drawing materials M1 to M4 filled inside respective four pipe members 1A to 1D by an operation of a user. In this embodiment, the drawing materials M1 to M4 are drawing materials with colors different from one another.

As the drawing materials M1 to M4, for example, the followings can be used: various stick-like cosmetic materials such as a lipstick, a lip gloss, an eyeliner, an eyebrow, a lip-liner, a cheek-color, a concealer, a cosmetic stick, hair color, and a nail art; or a stick-like core of a stationery and a similar material. Further, very soft (such as semisolid-shaped, soft solid-shaped, soft-shaped, jelly-shaped, mousse-shaped, and paste-shaped with these materials contained) stick-like members can be used. A thin-diameter stick-like member whose outer diameter is 1 mm or less, a general stick-like member whose outer diameter is from 1.5 to 3.0 mm, or a thick stick-like member whose outer diameter is 4.0 mm or more can also be used.

The feeding pencil 100 includes a leading tube 2 and a main body 3 as an external configuration. The leading tube 2 internally includes the pipe members 1A to 1D that load the drawing materials M1 to M4. The main body 3 is coupled to a rear end part of the leading tube 2 and engages with the leading tube 2 so as to be relatively rotatable. In the following description, an "axial line" means a center line of the feeding pencil 100 that extends to the front-to-rear of the feeding pencil 100, and an "axial direction" means a direction along the axial line in the front-to-rear direction. It is assumed that the direction in which the drawing materials M1 to M4 are fed out is a forward (a direction of forward movement), and a direction opposite from the forward (a retreat direction) is a rearward.

Figure 4:
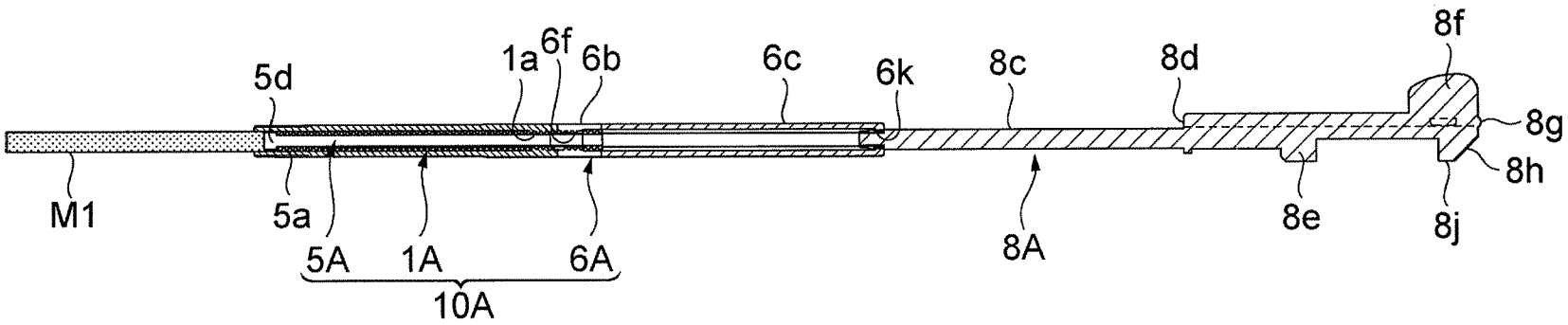
FIG. 4 is a vertical cross-sectional view illustrating a drawing material, a pipe member, a holding member, and a sliding part.

FIG. 4 is a vertical cross-sectional view illustrating a configuration of the pipe member 1A and a peripheral area thereof. As illustrated in FIG. 4, a stick-like movable body 5A having a male screw 5*a* is screwed with an inside of the pipe member 1A. The movable body 5A is held by a tubular holding member 6A. These pipe member 1A, movable body 5A, and holding member 6A can constitute a cartridge 10A exchangeable for the main body 3. Alternatively, a combination of the pipe member 1A and the movable body 5A can constitute an exchangeable cartridge. The pipe members 1B and 1C have a configuration similar to the pipe member 1A. It is also possible to constitute cartridges 10B and 10C with the pipe members 1B and 1C, movable bodies 5B and 5C, and holding members 6B and 6C, respectively. The same applies to the pipe member 1D.

The cartridge 10A includes a sliding part 8A and a spring 9A (see FIG. 5) at the rear part. The sliding part 8A is engaged to the holding member 6A in the axial direction. The spring 9A urges the sliding part 8A rearward. The cartridge 10A is removably attachable to the sliding part 8A in the axial direction. Similarly, the cartridges 10B and 10C include sliding parts 8B and 8C and springs 9B and 9C at the rear parts, respectively. The remaining one cartridge constituting the pipe member 1D similarly includes a sliding part and a spring.

Figure 5:
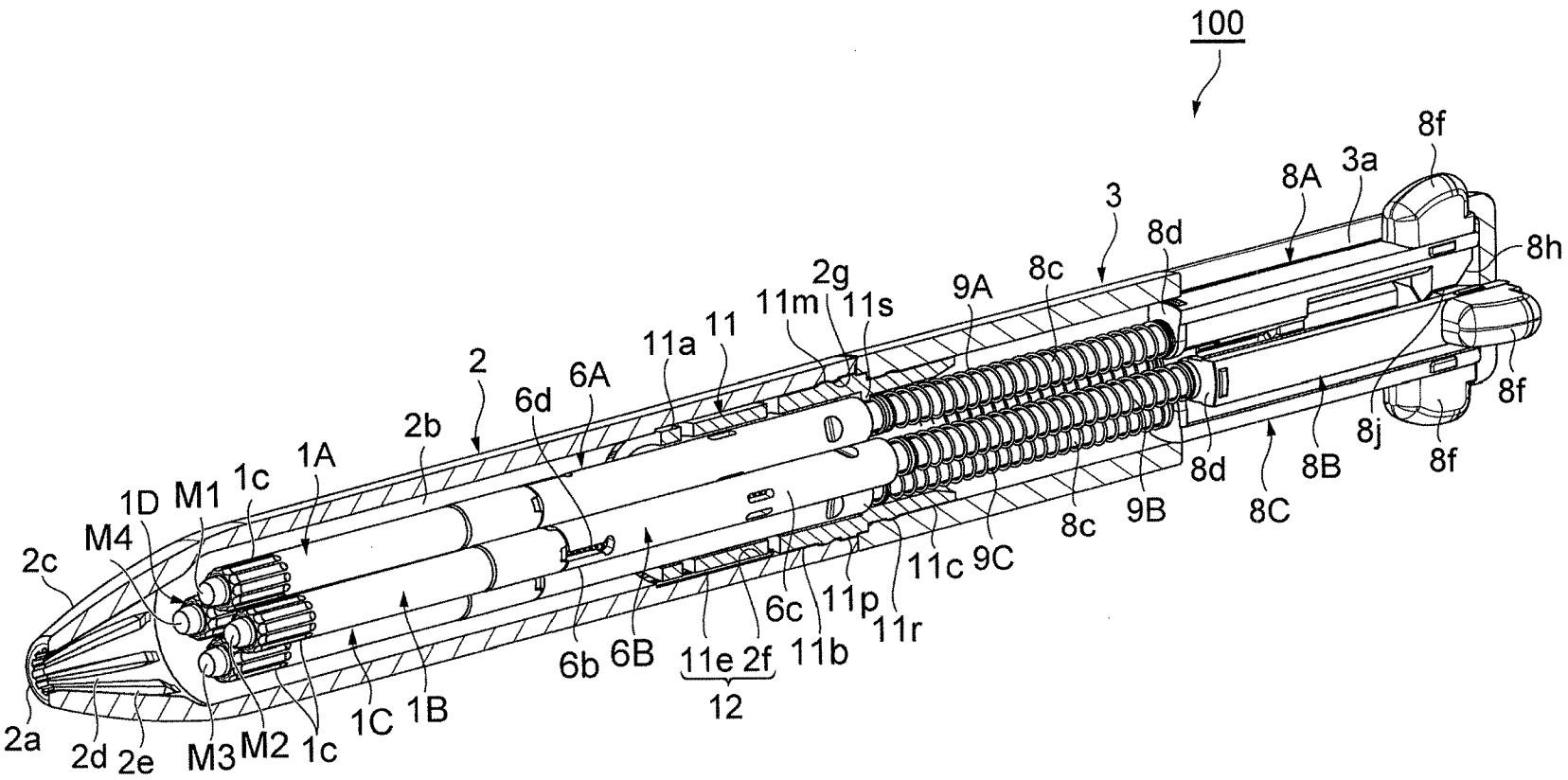
FIG. 5 is a cross-sectional perspective view illustrating the feeding pencil in FIG. 1.
Figure 6:
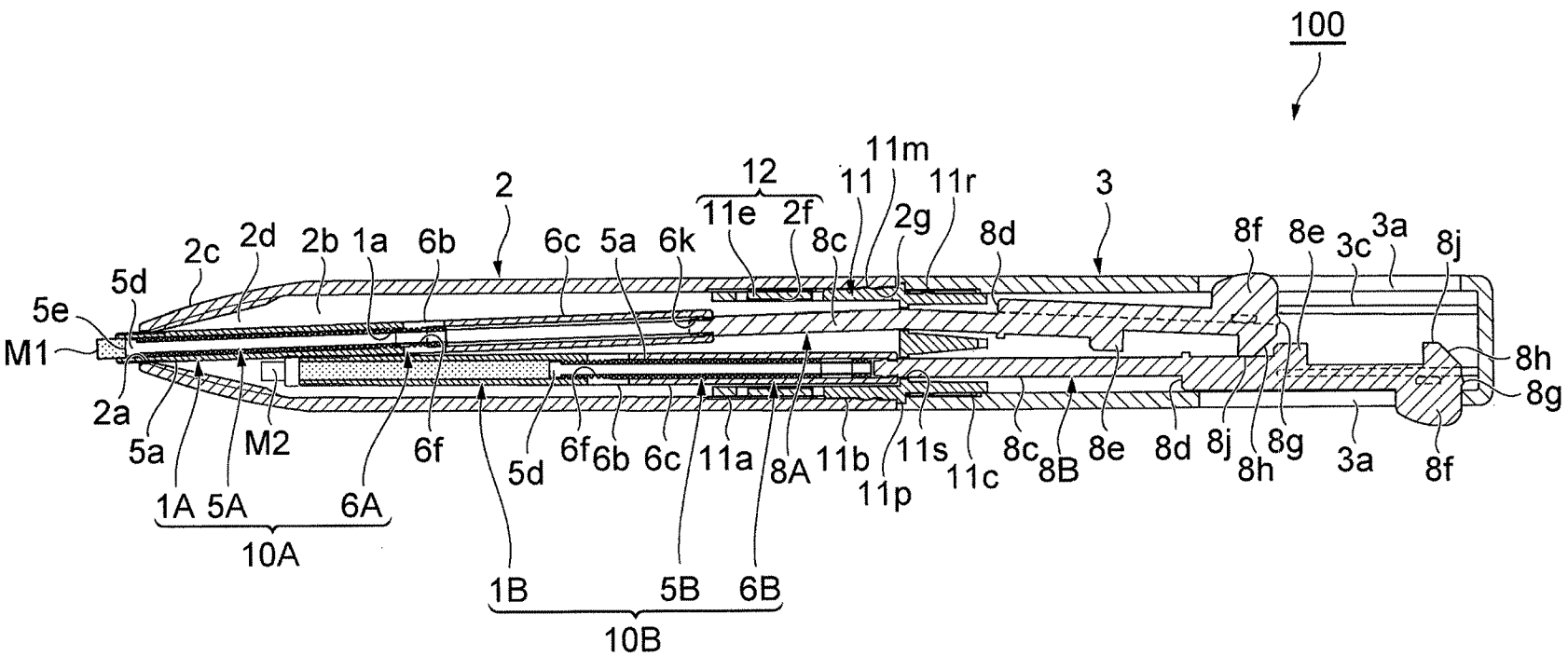
FIG. 6 is a vertical cross-sectional view illustrating the one sliding part in the feeding pencil in FIG. 1 moved forward.
Figure 7:
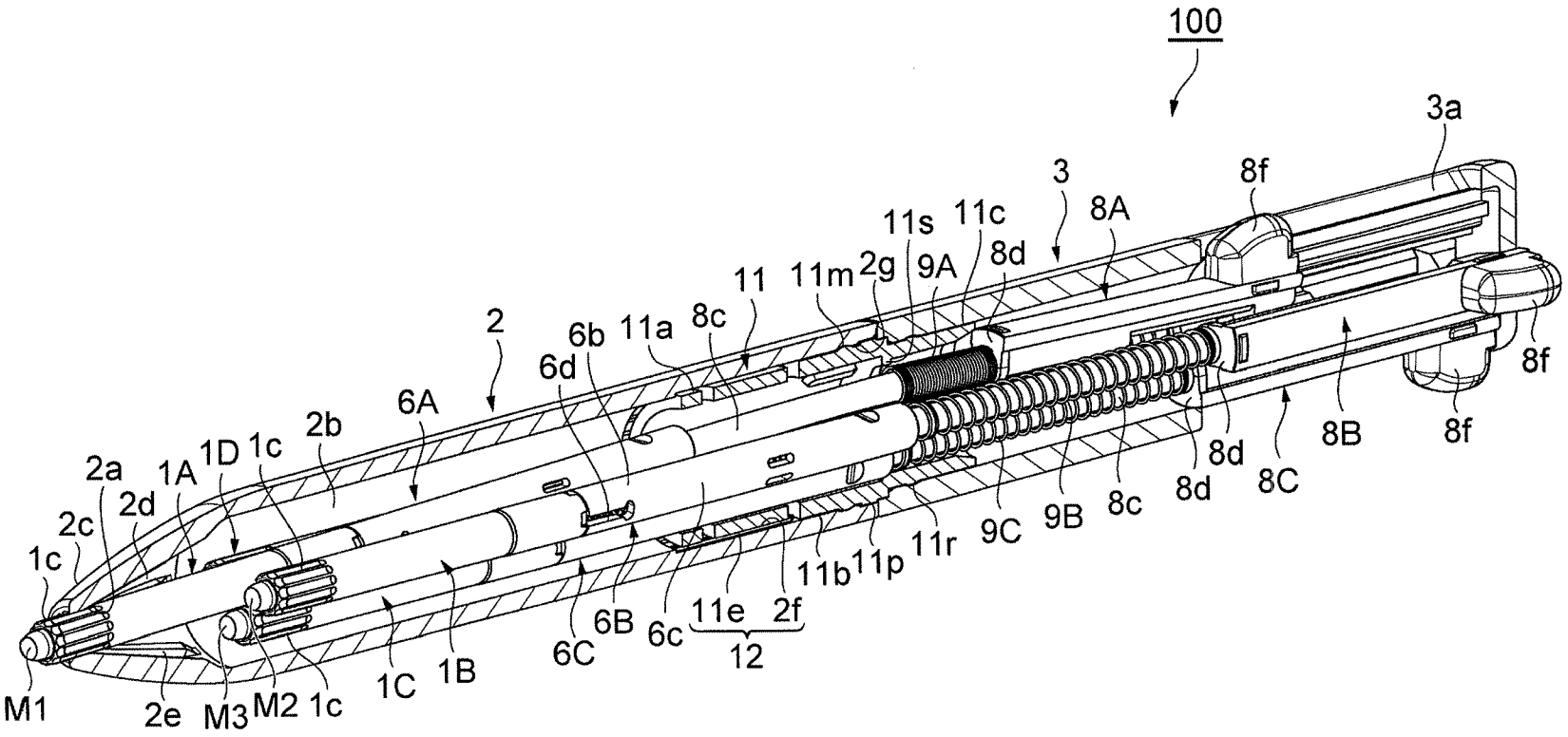
FIG. 7 is a cross-sectional perspective view illustrating the feeding pencil in a state of FIG. 6.

FIG. 5 and FIG. 6 are each cross-sectional perspective view and a vertical cross-sectional view of the feeding pencil 100. FIG. 7 is a cross-sectional perspective view illustrating a forward movement of the one sliding part 8A. As illustrated in FIG. 5 to FIG. 7, the leading tube 2 and the main body 3 internally include the four pipe members 1A to 1D that load the drawing materials M1 to M4, the four movable bodies such as the movable body 5A, the four holding members such as the holding member 6A, the four springs such as the spring 9A, and the four sliding parts such as the sliding part 8A. These four pipe members, four movable bodies, four holding members, four springs, and four sliding parts have an identical configuration except that the drawing materials M1 to M4 different from one another are loaded.

Accordingly, the following designates each of the four pipe members, the four movable bodies, the four holding members, the four springs, and the four sliding parts as a pipe member 1, a movable body 5, a holding member 6, a spring 9, and a sliding part 8. The four cartridges such as the cartridge 10A and the drawing materials M1 to M4 are referred to as a cartridge 10 and a drawing material M, respectively.

A middle tube 11 is engaged to a front end of the main body 3 so as to be synchronously rotatable. The four holding members 6 are held inside the middle tube 11. The middle tube 11 and the leading tube 2 include a ratchet mechanism 12 that allows a relative rotation between the leading tube 2 and the main body 3 (the middle tube 11) only in one direction. This ratchet mechanism 12 regulates the relative rotation between the leading tube 2 and the main body 3 in another direction opposite from the one direction.

Figure 8:
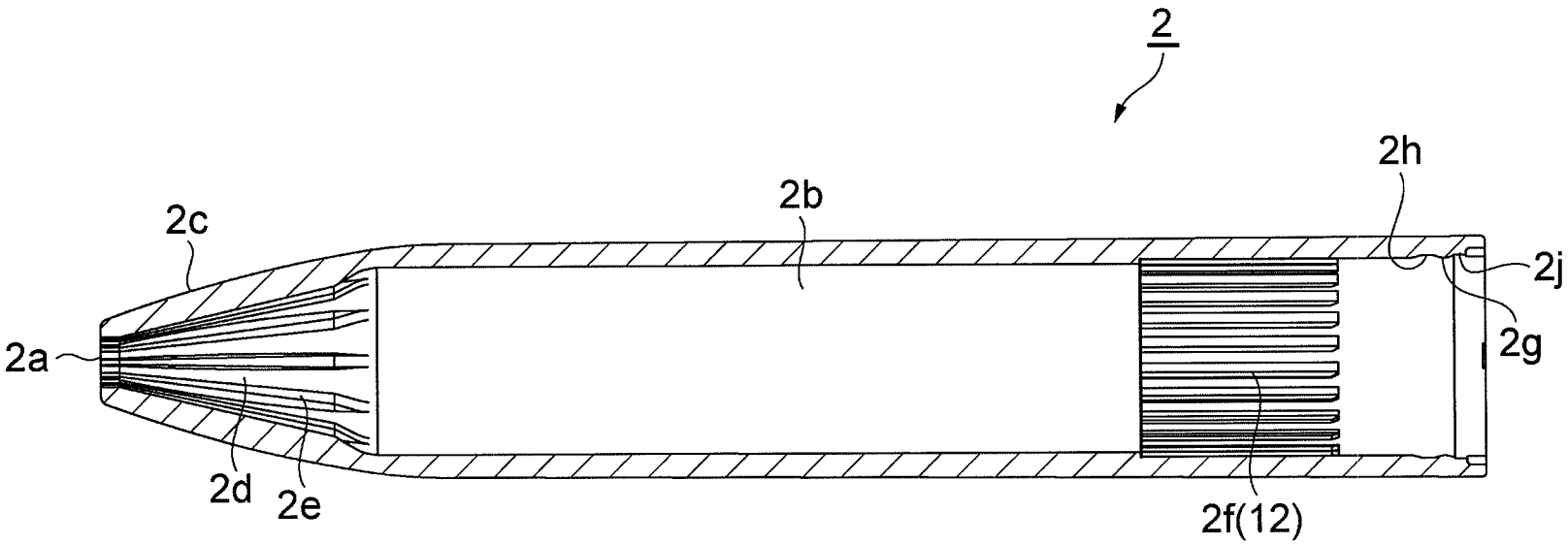
FIG. 8 is a vertical cross-sectional view illustrating a leading tube.

FIG. 8 is a vertical cross-sectional view illustrating the leading tube 2. As illustrated in FIG. 8, the leading tube 2 is made of an ABS resin (a copolymerization synthetic resin of acrylonitrile, butadiene, and styrene). The leading tube 2 has a tubular shape and an opening 2*a* to cause a front side part of the pipe member 1 to appear on the front end. The leading tube 2 includes therein a housing region 2*b* to house the four cartridges 10. Any one of the four pipe members 1, which are disposed inside the housing region 2*b*, is exposed from the opening 2*a* forward by user's operation.

On a front side of an outer circumferential surface of the leading tube 2, an inclined surface 2*c* is inclinedly disposed so as to be tapered to the front. An inner circumferential surface 2*d* on the front side of the leading tube 2 is also tapered to the front side. The inner circumferential surface 2*d* includes protrusions 2*e* that circumferentially have a large number of convex parts arranged side by side to engage the pipe members 1 in a rotation direction (a direction around the axial line). These convex parts extend in the inclining direction of the inner circumferential surface 2*d*. These protrusions 2*e* extend across the entire region from one end to the other end in this inclining direction. Circumferential intervals of these protrusions 2*e* shorten as approaching to the front side.

At a rear side portion of the inner circumferential surface of the leading tube 2, a concave-convex part 2*f*, which is one part constituting the ratchet mechanism 12, is disposed. The concave-convex part 2*f* circumferentially has 24 pieces of irregularities, which are arranged side by side and extend in the axial direction at a predetermined length. At the rear of the concave-convex part 2*f* in the inner circumferential surface of the leading tube 2, annular convex parts 2*g*, annular concave parts 2*h*, and annular concave parts 2*j* are disposed. The annular convex parts 2*g* engage with the middle tube 11 in the axial direction at the rear part of the leading tube 2. The annular concave parts 2*h* are positioned on the front side of the annular convex parts 2*g*. The annular concave parts 2*j* is positioned on the rear side of the annular concave parts 2*j*.

FIG. 9A is a side view illustrating the middle tube 11, and FIG. 9B is a vertical cross-sectional view illustrating the middle tube 11. The middle tube 11 is an injection molded product made of POM (polyacetal) and has an outer shape of stepped cylindrical shape. The middle tube 11 includes a front tube 11*a*, a center tube 11*b*, and a rear tube 11*c* in this order from the forward to the rearward. The center tube 11*b* has an outer shape with diameter larger than that of the front tube 11*a*. The rear tube 11*c* has an outer shape with diameter smaller than those of the front tube 11*a* and the center tube 11*b*.

The front tube 11*a* includes elastic projecting parts 11*e*, which constitute the other part of the ratchet mechanism 12, at a pair of positions opposed to one another in an inner circumferential surface 11*d*. These elastic projecting parts 11*e* engage with the concave-convex part 2*f* on the leading tube 2 in the rotation direction and are disposed protruding outwardly in a radial direction. At peripheral areas of the elastic projecting parts 11*e* in the front tube 11*a*, U-shaped notches 11*f* to communicate between the inside and the outside of the middle tube 11 are formed. These notches 11*f* give radial elasticity to the elastic projecting parts 11*e*. The elastic projecting parts 11*e* of the middle tube 11 are always brought into abutment with the concave-convex part 2*f* on the leading tube 2.

Figure 10:
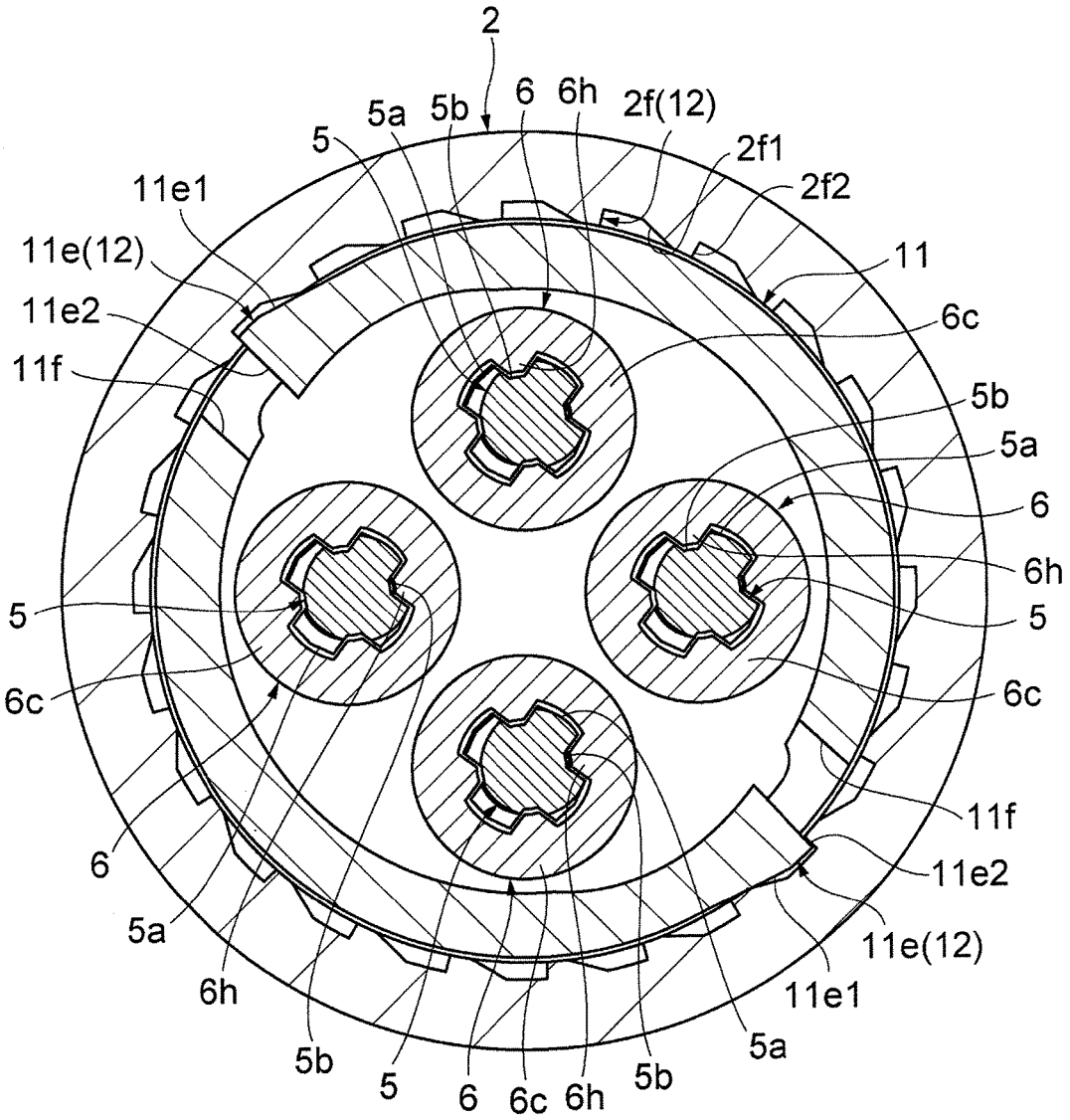
FIG. 10 is a cross-sectional view taken along the line A-A in FIG. 1.

FIG. 10 is a cross-sectional view taken along the line A-A in FIG. 1. As illustrated in FIG. 10, the concave-convex part 2*f* on the leading tube 2, which is the one part constituting the ratchet mechanism 12, includes inclined surfaces 2*f*1 and side surfaces 2*f*2. The inclined surfaces 2*f*1 incline with respect to the inner circumferential surface of the leading tube 2. The side surfaces 2*f*2 are formed to be approximately perpendicular to the inner circumferential surface of the leading tube 2. The elastic projecting parts 11*e* in the middle tube 11, which constitute the other part of the ratchet mechanism 12, includes an inclined surface 11*e*1 and a side surface 11*e*2. The inclined surface 11*e*1 inclines with respect to the outer circumferential surface of the middle tube 11. The side surface 11*e*2 is formed to be approximately perpendicular to a tangent line of the outer circumferential surface of the middle tube 11.

As illustrated in FIG. 9A and FIG. 9B, the notch 11*f* in the middle tube 11 includes a pair of slits 11*g* and 11*h* and a slit 11*j*. The slits 11*g* and 11*h* are drilled on both sides of the elastic projecting part 11*e* in the axial direction in the front tube 11*a* and circumferentially extend. The slit 11*j* is drilled on one side of the elastic projecting part 11*e* in the circumferential direction in the front tube 11*a*. Continuous with the slits 11*g* and 11*h*, the slit 11*j* extends in the axial direction. A wall part surrounded by the notches 11*f* in the front tube 11*a* forms an arm 11*k* having flexibility in the radial direction. Therefore, the elastic projecting part 11*e*, which is disposed on an outer surface at a tip end of the arm 11*k*, has an elastic force (an urging force) in the radial direction.

On an outer circumferential surface of the center tube 11*b* of the middle tube 11, projections 11*m*, an annular convex part 11*n*, and a collar part 11*p* are disposed. The projections 11*m* are removably engaged to the annular convex parts 2*g* on the leading tube 2. The annular convex part 11*n* enters into the annular concave parts 2*j* on the leading tube 2 from rearward. The collar part 11*p* is positioned at the rear of the annular convex part 11*n*. In the middle tube 11, a tube portion positioned on the front side with respect to the collar part 11*p* is inserted to the leading tube 2 from rearward.

On the rear tube 11*c* in the middle tube 11, protrusions 11*q* to engage with the main body 3 in the rotation direction are formed to extend in the axial direction. These protrusions 11*q* are formed at four uniformly arranged positions in the circumferential direction on an outer circumferential surface of the rear tube 11*c*. A convex part 11*r* to engage with the main body 3 in the axial direction is formed at the rear of the collar part 11*p*. This convex part 11*r* circumferentially extends between the protrusions 11*q*.

A holding member housing 11*s*, which is a site to insert the four holding members 6 through the axial direction, partitions the middle tube 11 at the inner surface side of the collar part 11*p*. This holding member housing 11*s* has circular openings 11*t* to insert the holding members 6 through the axial direction at four uniformly arranged positions in the circumferential direction.

In the middle tube 11, the front tube 11*a* and the center tube 11*b* are inserted to the inside of the leading tube 2 from the rear side. Then, the elastic projecting parts 11*e* in the front tube 11*a* engage with the concave-convex part 2*f* on the leading tube 2 in the rotation direction. The projections 11*m* on the center tube 11*b* engage with the annular convex parts 2*g* on the leading tube 2 and are fitted to the annular concave parts 2*h*. Further, the annular convex part 11*n* of the center tube 11*b* enters into the annular concave parts 2*j* on the leading tube 2.

Figure 11A:
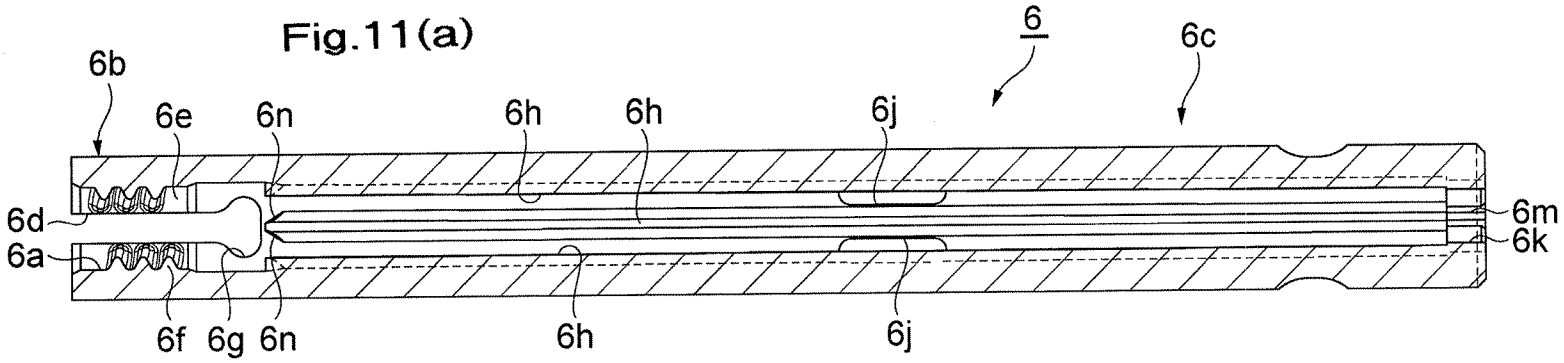
FIG. 11A is a vertical cross-sectional view illustrating a holding member.
Figure 11B:
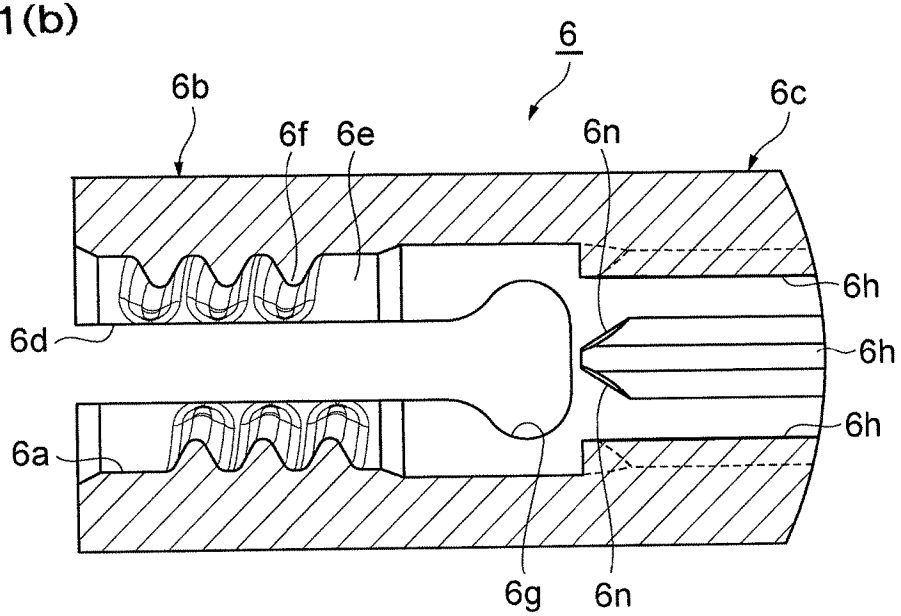
FIG. 11B is an enlarged view of a front end part of the holding member in FIG. 11A.

FIG. 11A is a vertical cross-sectional view illustrating the holding member 6, and FIG. 11B is an enlarged view of a front end of the holding member 6 in FIG. 11A. The holding member 6 entirely has a cylindrical shape. As a material of the holding member 6, for example, POM is employed. The holding member 6 includes a hole 6*a*, a movable body pressing part 6*b*, and a cylindrically-shaped tubular part 6*c*. The hole 6*a* is disposed on the front side of the holding member 6 and houses the movable body 5. The movable body pressing part 6*b* presses the movable body 5. The tubular part 6*c* extends rearward from the movable body pressing part 6*b*.

The movable body pressing part 6*b* of the holding member 6 includes a pair of slits 6*d*. The slits 6*d* extend from the front end to the rear side at a predetermined length so as to be mutually opposed at the inner circumferential surface of the movable body pressing part 6*b*. With the movable body pressing part 6*b* including the slits 6*d*, the elastic force of the resin of the holding member 6 tightens the movable body 5 to inwardly in the radial direction. These slits 6*d* allow the movable body pressing part 6*b* to expand the diameter outwardly in the radial direction.

An extension part 6*g*, which expands viewed from the radial direction, is formed at a rear end of the slits 6*d*. This extension part 6*g* appropriately adjusts the elastic force of tightening the movable body 5 from the movable body pressing part 6*b*. Protrusions 6*f* in a spiral pattern are formed on an inner surface 6*e* of the movable body pressing part 6*b*. The protrusions 6*f* are disposed at three positions on the inner surface 6*e* of the holding member 6 along the axial direction. These protrusions 6*f* are brought into abutment with the male screw 5*a* of the movable body 5 from outwardly in the radial direction. It is also possible to engage the movable body 5 in the axial direction and removably hold the movable body 5 with the holding member 6.

Four protrusions 6*h* are disposed at the inside of the tubular part 6*c* of the holding member 6. The protrusions 6*h* are disposed at four uniformly arranged positions in the circumferential direction and extend in the axial direction. These protrusions 6*h* are disposed as a rotation stopper for the movable body 5 with respect to the holding member 6. The protrusions 6*h* include tapered surfaces 6*n* tapered to the front end. These tapered surfaces 6*n* form the protrusions 6*h* to have a shape with which the movable body 5 is easily inserted from the front side.

These protrusions 6*h* form an internal space of the tubular part 6*c* into a non-circular shape (a cruciate shape) in a cross-sectional shape when the tubular part 6*c* is cut at a plane perpendicular to the axial direction (see FIG. 10). The tubular part 6*c* further includes through-holes 6*j* with ellipse shape extending in the axial direction so as to pass through the inside and the outside of the holding member 6. The through-holes 6*j* support core pins so as to prevent the core pins from being inclined by an injection pressure at the time of molding.

On an inner surface at the rear end of the holding member 6, a protrusion 6*m* and an annular convex part 6*k* are formed. The protrusion 6*m* engages with the sliding part 8 in the rotation direction. The annular convex part 6*k* engages with the sliding part 8 in the axial direction. The protrusion 6*m* is disposed on a straight line identical to the above-described protrusions 6*h*.

Figure 12A:
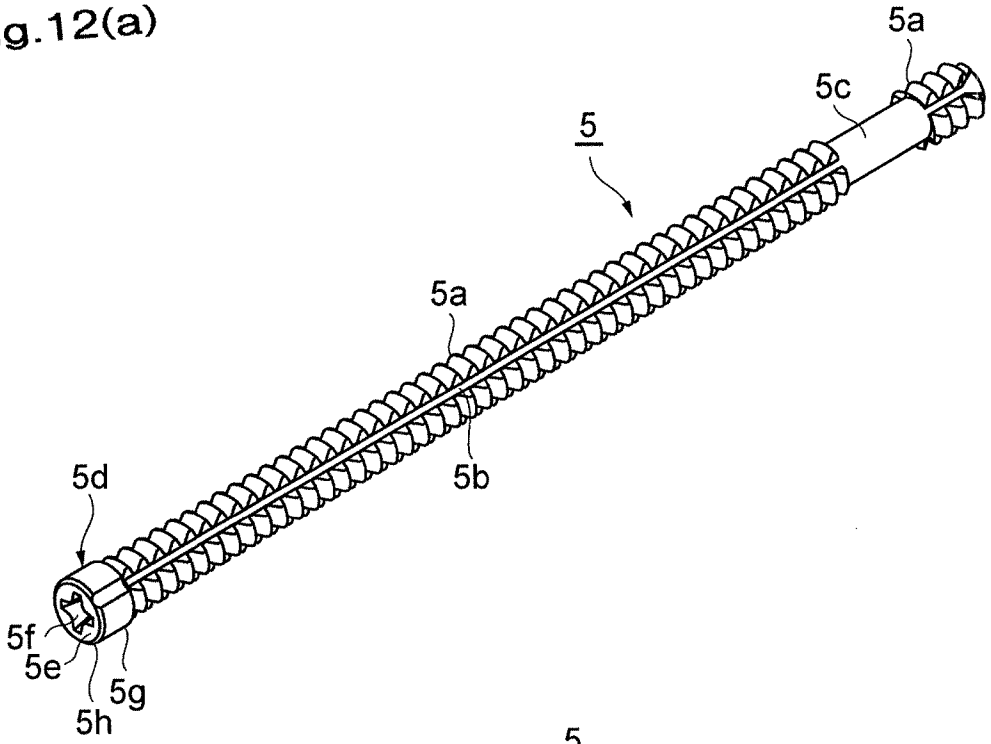
FIG. 12A is a perspective view illustrating a movable body.
Figure 12B:
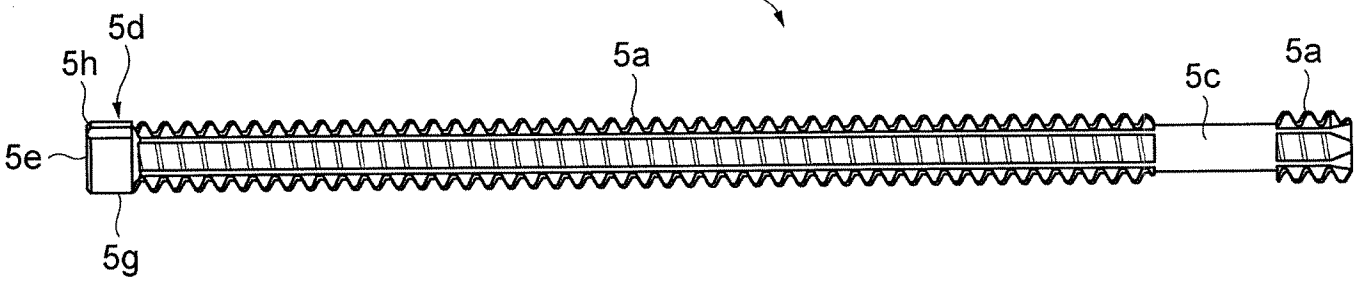
FIG. 12B is a side view illustrating the movable body.

FIG. 12A is a perspective view illustrating the movable body 5, and FIG. 12B is a side view illustrating the movable body 5. The movable body 5 has a stick-like outer shape. As a material of the movable body 5, for example, POM is employed. The movable body 5 includes the male screw 5*a* and four grooves 5*b*, which extend in the axial direction, on the outer circumferential surface. The grooves 5*b* are disposed at four uniformly arranged positions in the circumferential direction.

The movable body 5 has a curved surface part 5*c* where the male screw 5*a* is not formed on the surface at the rear side. This curved surface part 5*c* is disposed to spin around the movable body 5 when the movable body 5 reaches an advance limit. Inserting the male screw 5*a*, which is positioned at the rear of the curved surface part 5*c*, to the rear of the protrusions 6*f* during attachment to the holding member 6 prevents the movable body 5 from dropping from the holding member 6. The movable body 5 wholly forms the male screw 5*a* in the axial direction. The "wholly forming in the axial direction" includes the case where the male screw 5*a* is not partially formed such as the case where the curved surface part 5*c* is formed in the middle of the movable body 5 in the axial direction like this embodiment, in addition to the case where the male screw 5*a* is formed on all parts of the movable body 5 in the axial direction.

The four grooves 5*b* on the movable body 5 are disposed to enter the movable body 5 into the protrusions 6*h* on the holding member 6 (see FIG. 10). These grooves 5*b* are disposed to rotate the movable body 5 synchronously with the holding member 6. These grooves 5*b* form the cross-sectional shape when the male screw 5*a* and the grooves 5*b* are cut at the plane perpendicular to the axial direction into the non-circular shape (the cruciate shape) corresponding to the internal space of the tubular part 6*c* of the holding member 6.

A pitch of the male screw 5*a* in the movable body 5 (a distance between screw threads of the male screw 5*a* in the axial direction) is, for example, 0.3 mm or more to 1.0 mm or less and preferably 0.6 mm. The conventional pitch of the male screw is typically 2.0 mm or more to 6.0 mm or less. Accordingly, the pitch of the male screw 5*a* is a fine pitch shorter than the pitch of the general male screws.

The male screw 5*a* and the grooves 5*b* in the movable body 5 are inserted from the forward into the holding member 6 so as to provide a clearance between the grooves 5*b* and the protrusions 6*h*. Engaging the protrusions 6*f*, which are disposed on the inner surface 6*e* of the holding member 6, with the male screw 5*a* on the movable body 5 holds the movable body 5 by the holding member 6. At this time, the protrusions 6*f* press the male screw 5*a* from outwardly in the radial direction, thus increasing a holding force of the movable body 5 by the holding member 6.

A column-shaped extruding part 5*d* is disposed on the front end of the movable body 5 to extrude the drawing material M inside the pipe member 1 forward. The extruding part 5*d* includes a bottom surface 5*e*, which is positioned on the front end, a concave part 5*f*, which is concaved into a cross shape from the bottom surface 5*e*, a side surface 5*g*, which circumferentially extends, and a tapered surface 5*h*, which inclines with respect to the bottom surface 5*e* and is continuous with the bottom surface 5*e* and the side surface 5*g*. The concave part 5*f* is a hole to insert a tool to rotate the movable body 5 during the attachment of the movable body 5. Inserting this tool into this concave part 5*f* allows the movable body 5 to rotate during the attachment and similar work. The bottom surface 5*e* is a surface to extrude the drawing material M forward.

Figure 13A:
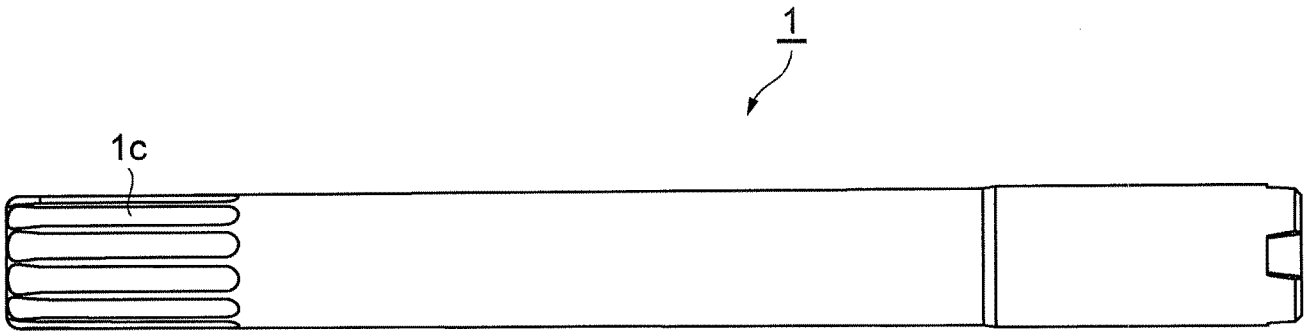
FIG. 13A is a side view illustrating the pipe member.
Figure 13B:
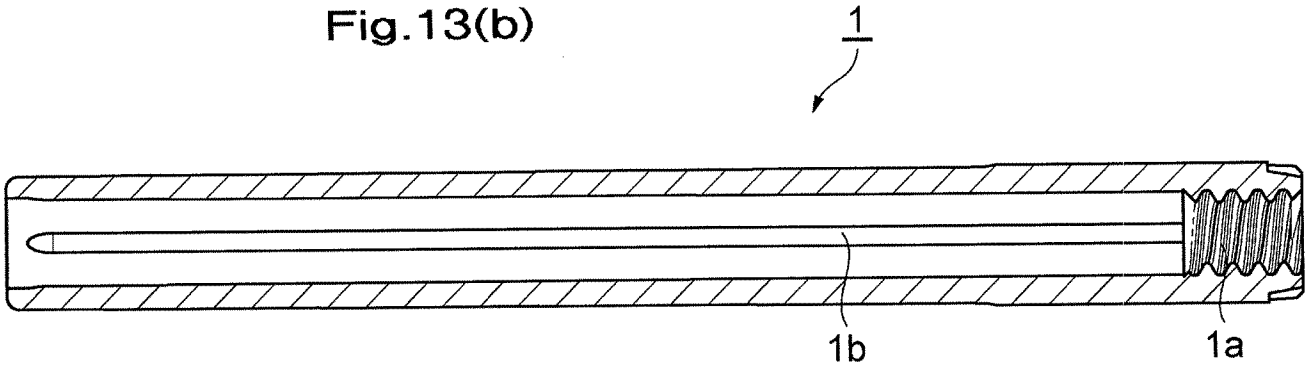
FIG. 13B is a vertical cross-sectional view illustrating the pipe member.

FIG. 13A is a side view illustrating the pipe member 1, and FIG. 13B is a vertical cross-sectional view illustrating the pipe member 1. The pipe member 1 has an approximately cylindrical shape. As a material of the pipe member 1, for example, PP (polypropylene) is employed. Coloring the pipe member 1 with color identical to the drawing material M or configuring the pipe member 1 made of a transparent material ensures easy identification of the color of the drawing material M. A female screw 1*a* is formed on the rear side of the inner circumferential surface on the pipe member 1 to move the movable body 5 in the axial direction. Similar to the male screw 5*a* on the movable body 5, a pitch of the female screw 1*a* on the pipe member 1 (a distance between screw threads of the female screw 1*a* in the axial direction) is a fine pitch shorter than the pitch of the general female screws.

At the front of the female screw 1*a* in the inner surface of the pipe member 1, protrusions 1*b* extending in the axial direction are disposed at four uniformly arranged positions in the circumferential direction. These protrusions 1*b* ensure preventing the drawing material M loaded to the pipe member 1 from exiting. Although the number of the protrusions 1*b* is not especially limited, the four protrusions 1*b* further effectively prevent the drawing material M from exiting. A concave groove 1*c* is disposed on the front side part on the outer circumferential surface of the pipe member 1 to be engaged to the protrusions 2*e* of the leading tube 2 in the rotation direction. A plurality of concave parts extending in the axial direction at a predetermined length are circumferentially arranged side by side on the concave groove 1*c*.

Figure 14A:
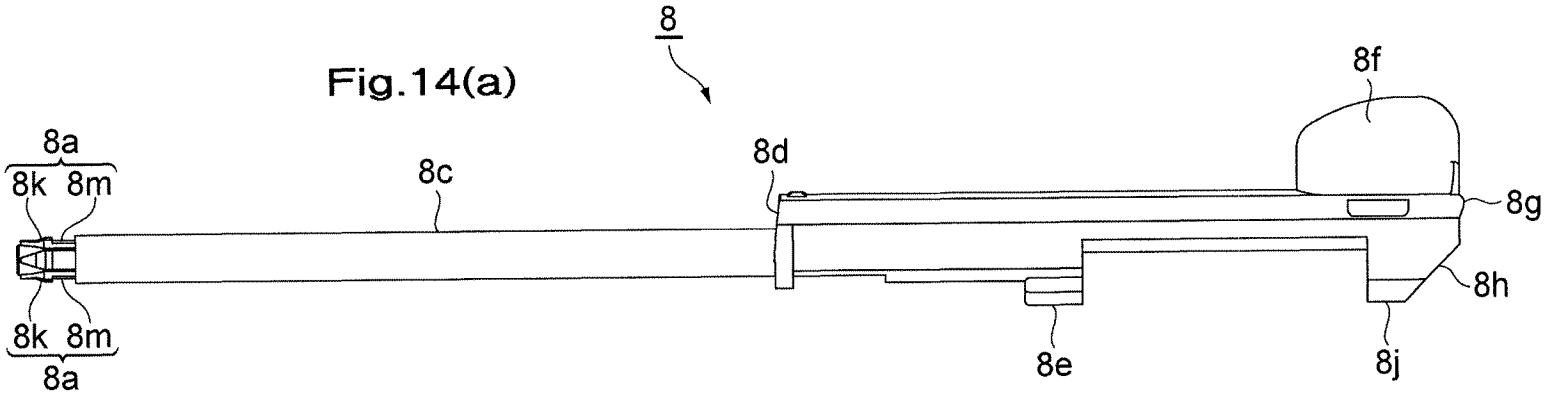
FIG. 14A is a side view illustrating a the sliding part.
Figure 14B:
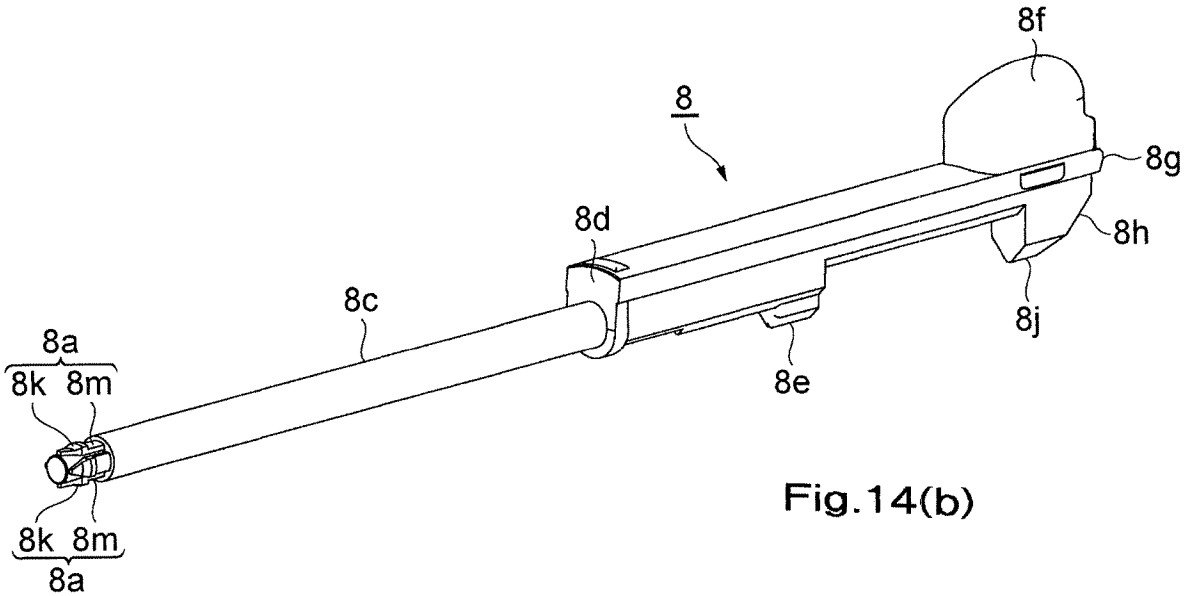
FIG. 14B is a perspective view illustrating the sliding part.

FIG. 14A is a side view illustrating the sliding part 8, and FIG. 14B is a perspective view illustrating the sliding part 8. As a material of the sliding part 8, for example, an ABS resin is employed. A color of the sliding part 8 is, for example, identical to the color of the corresponding drawing material M. Sliding the sliding part 8 with desired color forward by a predetermined amount allows the drawing material M with the desired color to be exposed from the opening 2*a* on the leading tube 2.

The sliding part 8 has a shape extending in the axial direction. On a front end of the sliding part 8, four claws 8*a* are disposed to be inserted into the tubular part 6*c* of the holding member 6 from the rear side. The claws 8*a* are each disposed at four uniformly arranged positions in the circumferential direction. The claws 8*a* each have an elastic force in the radial direction and are removably engaged to the annular convex part 6*k* of the holding member 6. The claw 8*a* includes an inclined part 8*k*, which is tapered to the front, and a concave part 8*m*. The concave part 8*m* engages the annular convex part 6*k* in the axial direction at a rear end of the inclined part 8*k*. Providing the inclined part 8*k* to this claw 8*a* forms the sliding part 8 into a shape with which the sliding part 8 is easily inserted into the holding member 6.

The sliding part 8 includes a round-stick-shaped stick-like part 8*c* around which the spring 9 is wound on the front side. At a rear end of the stick-like part 8*c*, a flat surface 8*d* is disposed projecting from the stick-like part 8*c* to outwardly in the radial direction. The stick-like parts 8*c* are inserted through openings 11*t* on the holding member housing 11*s* of the middle tube 11 in the axial direction. One end of the spring 9 is brought into abutment with the flat surface 8*d*. Thus, the sliding part 8 includes the stick-like part 8*c*, which is disposed on the front side, and the flat surface 8*d*, which projects outwardly in the radial direction at the rear end of the stick-like part 8*c*, thus having the shape such that the spring 9 is easily attached.

A projecting part 8*e* is disposed on the rear side of the sliding part 8 to pull and return the other sliding parts 8 rearward. This projecting part 8*e* projects inwardly in the radial direction in the main body 3 and extends in the axial direction. On the rear end of the sliding part 8, a projecting part 8*f*, a rear end part 8*g*, and a projecting part 8*j* are disposed. The projecting part 8*f* projects outwardly in the radial direction from the main body 3. The rear end part 8*g* projects rearward at the rear end of the sliding part 8 and is hooked to the main body 3. The projecting part 8*j* projects inwardly in the radial direction of the main body 3 and has an inclined surface 8*h*. The projecting parts 8*e* of the other sliding parts 8 are brought into abutment with the inclined surface 8*h*.

The holding member 6 is engaged to the front end of the sliding part 8 configured as described above. At this time, engaging the claws 8*a* on the sliding part 8 with the annular convex part 6*k* on the holding member 6 in the axial direction engages the holding member 6 to the front end of the sliding part 8 in the axial direction, thus ensuring removably holding the sliding part 8.

Figure 15A:
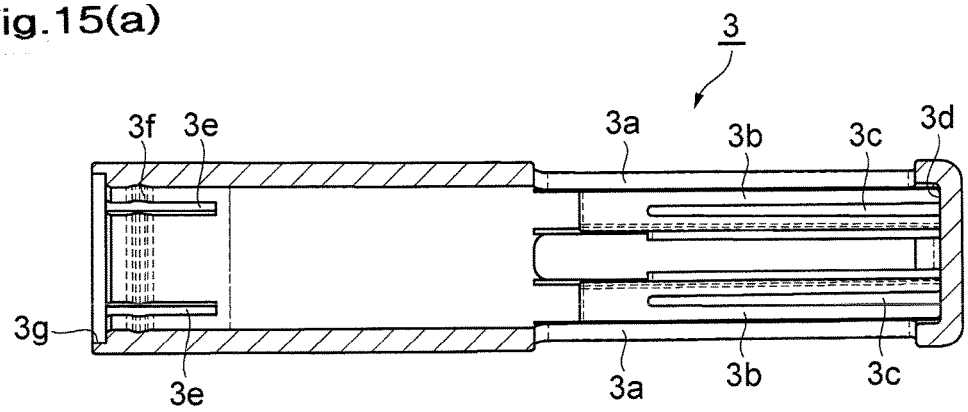
FIG. 15A is a vertical cross-sectional view illustrating a main body.
Figure 15B:
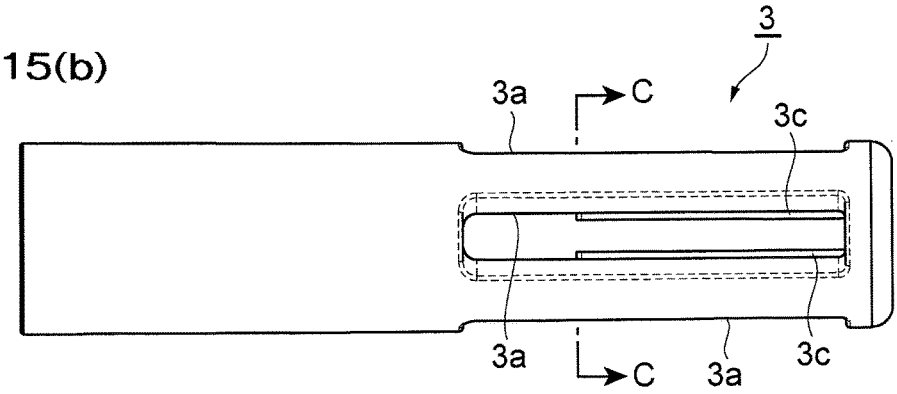
FIG. 15B is a side view illustrating the main body.
Figure 15C:
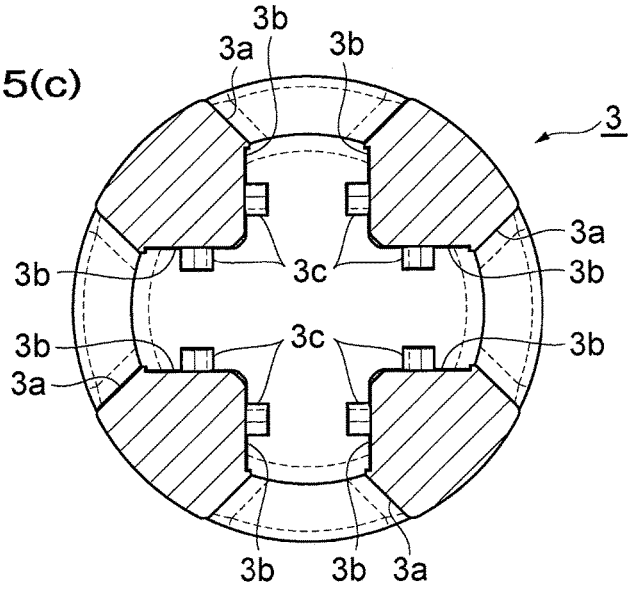
FIG. 15C is a cross-sectional view taken along the line C-C in FIG. 15B.

FIG. 15A is a vertical cross-sectional view illustrating the main body 3, FIG. 15B is a side view illustrating the main body 3, and FIG. 15C is a cross-sectional view taken along the line C-C in FIG. 15B. The main body 3 is an injection molded product made of ABS resin and has a closed-bottomed cylindrical shape. Cut-out parts 3*a* extending in the axial direction to project the projecting part 8*f* on the sliding part 8 outward are disposed on the rear side of the main body 3. The cut-out parts 3*a* are disposed at four uniformly arranged positions in the circumferential direction.

Flat parts 3*b* and projecting parts 3*c* are disposed at the cut-out parts 3*a* of the main body 3 inwardly in the radial direction. The flat part 3*b* extends from the cut-out part 3*a* inwardly in the radial direction. The projecting part 3*c* extends in the axial direction at the flat part 3*b*. The rear side of the projecting part 3*c* extends up to a bottom surface 3*d* on the main body 3. As illustrated in FIG. 6, moving the projecting part 8*f* of the sliding part 8 forward along the cut-out parts 3*a* on the main body 3 moves the rear end part 8*g* of the sliding part 8 forward along the projecting parts 3*c*.

When the rear end part 8*g* reaches the front end of the projecting parts 3*c*, this rear end part 8*g* enters into the cut-out parts 3*a* inwardly in the radial direction, and the rear end part 8*g* is hooked to the front ends of the projecting parts 3*c*. While the rear end part 8*g* of the one sliding part 8 (for example, the sliding part 8A in FIG. 6) is hooked to the front ends of the projecting parts 3*c*, the projecting part 8*e* of the other sliding part 8 (for example, the sliding part 8B in FIG. 6) closely contacts the inclined surface 8*h* of the one sliding part 8.

As illustrated in FIG. 15A, concave grooves 3*e*, an annular concave part 3*f*, and an annular concave part 3*g* are disposed on a front side of an inner circumferential surface of the main body 3. The concave grooves 3*e* engage with the protrusions 11*q* on the middle tube 11 in the rotation direction. The convex part 11*r* on the middle tube 11 engages with the annular concave part 3*f* in the axial direction. The collar part 11*p* on the middle tube 11 enters into the annular concave part 3*g* from the forward. The concave grooves 3*e* extend from the annular concave part 3*g*, which is positioned on the front end of the main body 3, to the rearward at a predetermined length. The concave grooves 3*e* are disposed at four uniformly arranged positions in the circumferential direction on the inner circumferential surface of the main body 3. The annular concave part 3*f* circumferentially extends between the concave grooves 3*e*.

The four sliding parts 8 are inserted into the main body 3 from the front side. The projecting parts 8*f* on the sliding parts 8 outwardly project from the cut-out parts 3*a*. The middle tube 11 enters into the front end of the main body 3. When the middle tube 11 enters into the main body 3, the protrusions 11*q* on the middle tube 11 enter into the concave grooves 3*e* on the main body 3. The convex part 11*r* on the middle tube 11 engages with the annular concave part 3*f* on the main body 3 in the axial direction. Then, the collar part 11*p* on the middle tube 11 enters into the annular concave part 3*g*, thus, the middle tube 11 is engaged to the main body 3 to be synchronously rotatable.

As illustrated in FIG. 5 and FIG. 7, the spring 9 (the springs 9A to 9C) is wound around the stick-like part 8*c* so as to provide the clearance with the outer periphery of the stick-like part 8*c* of the sliding part 8. One end (the front end) of the spring 9 is brought into abutment with the rear wall on the holding member housing 11*s* at the middle tube 11. Meanwhile, the other end (the rear end) is brought into abutment with the flat surface 8*d*, which is positioned near the center of the sliding part 8 in the axial direction.
This spring 9 urges the sliding part 8 rearward.

The following describes operations of the feeding pencil 100 configured as described above for use. The feeding pencil 100 in an initial state illustrated in FIG. 5 positions the four sliding parts 8 at the rear end of the cut-out parts 3*a* on the main body 3 and positions the four pipe members 1 inside the leading tube 2. As illustrated in FIG. 6 and FIG. 7, with this state, moving the sliding part 8A forward along the cut-out parts 3*a* by a predetermined amount moves the cartridge 10A, which is engaged to the sliding part 8A in the axial direction, forward, and the drawing material M1 is exposed forward from the opening 2*a* on the leading tube 2.

At this time, entering the front side part of the pipe member 1A into the inner circumferential surface 2*d* on the leading tube 2 warps the stick-like part 8*c* of the sliding part 8A so as to curve with respect to the axial direction, and the concave groove 1*c* on the pipe member 1A engages with the protrusions 2*e* on the leading tube 2 in the rotation direction. Then, the rear end part 8*g* of the sliding part 8A enters inwardly in the radial direction at the front end of the projecting parts 3*c* on the main body 3.

In this state, for example, when the user relatively rotates the main body 3 in one direction (for example, a clockwise direction) with respect to the leading tube 2, the middle tube 11, the four sliding parts 8, the four holding members 6, and the four movable bodies 5 start rotating in the one direction. The pipe members 1B to 1D where the concave grooves 1*c* are not engaged to the protrusions 2*e* on the leading tube 2 rotate in association with the relative rotation in the one direction.

Meanwhile, the holding member 6A coupled to the pipe member 1A where the concave groove 1*c* is engaged to the protrusions 2*e* on the leading tube 2 via the movable body 5A starts rotating in the one direction in association with the relative rotation in the one direction. The pipe member 1A where the concave groove 1*c* is engaged to the protrusions 2*e* on the leading tube 2 does not rotate together with the rotation of the movable body 5A in the one direction, and the movable body 5A relatively rotates with respect to the pipe member 1A. Accordingly, the relative rotation in the one direction acts a screwing action between the male screw 5*a* on the movable body 5 and the female screw 1*a* on the pipe member 1, and the movable body 5A starts moving forward with respect to the pipe member 1A. When the bottom surface 5*e* on the extruding part 5*d* of the movable body 5A extrudes the drawing material M1, which is loaded in the pipe member 1A, forward, the movable body 5A and the drawing material M1 start moving forward together with respect to the pipe member 1A.

As illustrated in FIG. 10, at the relative rotation in the one direction, the elastic projecting parts 11*e*, which constitute the ratchet mechanism 12, on the middle tube 11 engage with the concave-convex part 2*f* on the leading tube 2 in the rotation direction, and the elastic force by the notches 11*f* radially urges the elastic projecting parts 11*e*. This repeats the engagement and disengagement (mesh and disengagement of the mesh) between the elastic projecting parts 11*e* and the concave-convex part 2*f*. That is, performing the relative rotation in the one direction with the elastic projecting parts 11*e* and the concave-convex part 2*f* engaged in the rotation direction brings inclined surfaces 11*e*1 of the elastic projecting parts 11*e* into abutment with the inclined surfaces 2*f*1 of the concave-convex part 2*f*. With this state, the inclined surfaces 11*e*1 slide so as to move up over the inclined surfaces 2*f*1.

After the elastic projecting parts 11*e* exceed the convex parts on the concave-convex part 2*f*, the elastic projecting parts 11*e* engage with the concave-convex part 2*f* again in the rotation direction. Consequently, each time that the elastic projecting parts 11*e* and the concave-convex part 2*f* engage and disengage with one another, a click feeling is provided to the user. The concave-convex part 2*f* has 24 irregularities arranged side by side in the circumferential direction; therefore, each time that the relative rotation is performed in the one direction by 15°, the click feeling is provided to the user.

Meanwhile, when the user attempts to relatively rotate the main body 3 in the other direction (for example, counter-clockwise), which is a direction opposite from the one direction, with respect to the leading tube 2, the side surfaces 11*e*2 on the elastic projecting parts 11*e*, which constitute the ratchet mechanism 12, are brought into abutment with the side surfaces 2*f*2 on the concave-convex part 2*f*, thus regulating the relative rotation in the other direction. Accordingly, the leading tube 2 and the main body 3 do not relatively rotate in the other direction. That is, a rotational force (a torque) in the relative rotation in the one direction is set to be a force of ensuring easy rotation while a rotational force in the relative rotation in the other direction is set to a force by which the rotation is not easily performed. For example, with the outer diameter of the main body 3 designed around 14 mm, the torque of the relative rotation in the one direction is set to be 0.1 N·m (newton-meter) or less, and the torque of the relative rotation in the other direction is set to be 0.2 N·m or more.

As illustrated in FIG. 6, in the state where the forward movement of the sliding part 8A moves the pipe member 1A forward and the drawing material M1 is exposed forward, moving the other sliding part 8B forward by the predetermined amount brings the projecting part 8*e* on the sliding part 8B near the inclined surface 8*h* of the sliding part 8A into abutment with the inclined surface 8*h* of the sliding part 8A. The abutment of the projecting part 8*e* on the sliding part 8B with the inclined surface 8*h* of the sliding part 8A extrudes the sliding part 8A outwardly in a radial direction, thus disengaging the rear end part 8*g* of the sliding part 8A with the front end of the projecting parts 3*c*. The urging force by the spring 9A to the rear presses and returns the sliding part 8A to the rear end position of the cut-out parts 3*a*.

As described above, this feeding pencil 100 includes the ratchet mechanism 12 that allows the relative rotation between the leading tube 2 and the main body 3 in the one direction and regulates the relative rotation in the other direction. The ratchet mechanism 12 includes the elastic projecting parts 11*e*, which project from the outer surface on the front tube 11*a* (the tube portion) of the middle tube 11, and the concave-convex part 2*f* on the inner surface of the leading tube 2. In this ratchet mechanism 12, the concave-convex part 2*f* on the inner surface of the leading tube 2 is movable with respect to the elastic projecting parts 11*e* on the outer surface of the front tube 11*a* in the axial direction.

The projections 11*m* disposed on the outer surface of the center tube 11*b* (the tube portion) in the middle tube 11 removably engage with the annular convex parts 2*g*, which are disposed on the inner surface of the leading tube 2, in the axial direction. Thus, the middle tube 11 doubles as a function of the ratchet mechanism 12 by the elastic projecting parts 11*e* and a function to be removably attachable by the projections 11*m* with the one component. Therefore, the leading tube 2 can be removably attachable to the middle tube 11 in the axial direction, thereby ensuring easy decomposition by removing the leading tube 2 from the middle tube 11. Accordingly, in case of a failure in the component such as the internal cartridge 10, the user can remove the leading tube 2 and easily exchange the internal component.

With the feeding pencil 100, the plurality of drawing materials M are stored in the leading tube 2. The leading tube 2 includes the plurality of sliding parts 8 coupled to the plurality of respective drawing materials M and slidable with respect to the main body 3 by the predetermined amount. Among the plurality of sliding parts 8, the forward movement of the one any given sliding part 8 with respect to the main body 3 by the predetermined amount moves the one any given drawing material M forward. Accordingly, the plurality of drawing materials M can be stored in the one feeding pencil 100 and the one any given drawing material M can be moved forward for use.

That is, the feeding pencil 100 includes the pluralities of pipe members 1, movable bodies 5, and holding members 6. The feeding pencil 100 includes the plurality of sliding parts 8 coupled to the plurality of respective holding members 6 and slidable with respect to the main body 3 by the predetermined amount. Among the plurality of sliding parts 8, the forward movement of the any given sliding part 8 with respect to the main body 3 by the predetermined amount exposes the one any given drawing material M from the leading tube 2. With this state, relatively rotating the leading tube 2 and the main body 3 in the one direction moves the drawing material M forward. This allows the one feeding pencil 100 to internally house the plurality of drawing materials M. Even if the plurality of drawing materials M are housed, this also ensuring maintaining the small-diameter feeding pencil.

The feeding pencil 100 loads the drawing materials M to the inside of the pipe members 1 and houses the movable bodies 5 inside the pipe members 1 and the holding members 6. The movable body 5 wholly forms the male screw 5*a* in the axial direction. This ensures screwing and holding the male screw 5*a* at any given position by the pipe member 1 and the holding member 6. The male screw 5*a* of this movable body 5 is screwed with the female screw 1*a* on the inner surface of the pipe member 1 and is brought into abutment with the protrusions 6*f*, which are disposed at the rear of the pipe member 1, on the inner surface 6*e* of the holding member 6 from the outside.

Figure 16A:
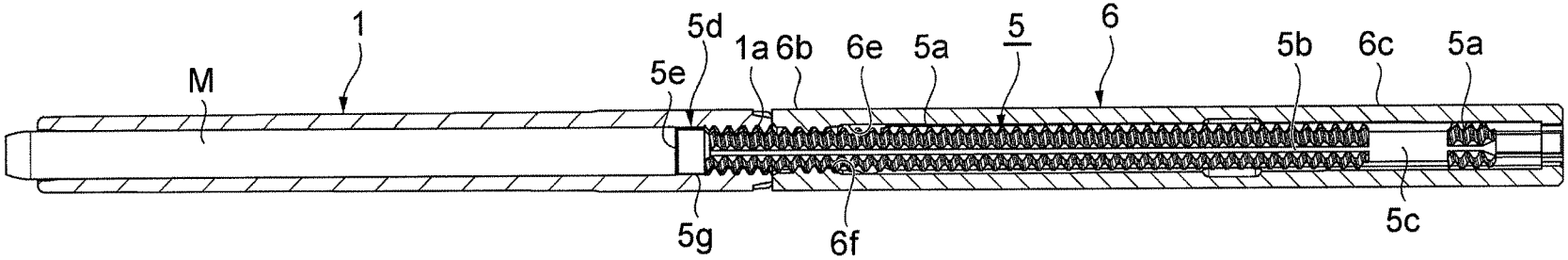
FIG. 16A is a vertical cross-sectional view illustrating the pipe member, the movable body, and the holding member.
Figure 16B:
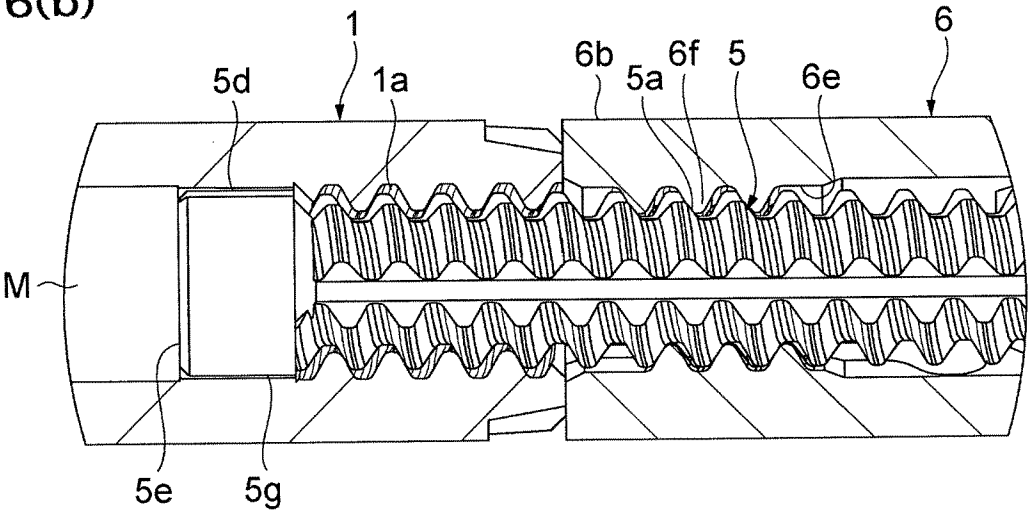
FIG. 16B is a diagram enlarging a vicinity of a rear end of the pipe member in FIG. 16A.

Accordingly, as illustrated in FIG. 16A and FIG. 16B, which are the vertical cross-sectional views of the pipe member 1, the movable body 5, and the holding member 6, the pipe member 1 screwed with the movable body 5 and the holding member 6 holding the movable body 5 can be arranged in the axial direction, thus restraining a radial enlargement of the feeding pencil 100. Therefore, this feeding pencil 100 can achieve the small-diameter feeding pencil 100.

With the feeding pencil 100, for example, the inner diameter of the screw thread of the female screw 1*a* on the pipe member 1 is slightly larger than the inner diameter of the protrusion 6*f* on the holding member 6. In view of this, although the fine clearance is formed between the male screw 5*a* of the movable body 5 and the screw thread of the female screw 1*a*, a clearance is not formed between the male screw 5*a* and the protrusions 6*f*, thereby ensuring always bringing the protrusions 6*f* into abutment with the male screw 5*a*.

The protrusions 6*f* on the holding member 6 are formed in the spiral pattern on the inner surface 6*e* on the holding member 6. This allows the protrusions 6*f* to be engaged to the male screw 5*a* along the shape of the male screw 5*a*, thereby ensuring increasing the holding force of the male screw 5*a* by the holding member 6.

The holding member 6 includes the slits 6*d* extending in the axial direction from the end part on the front side. Providing these slits 6*d* ensures increasing the radial elastic force at the end part on the front side of the holding member 6. This ensures increasing the radial holding force by the holding member 6, thereby ensuring further reliably restraining the exit of the movable body 5 from the holding member 6.

Figure 9:
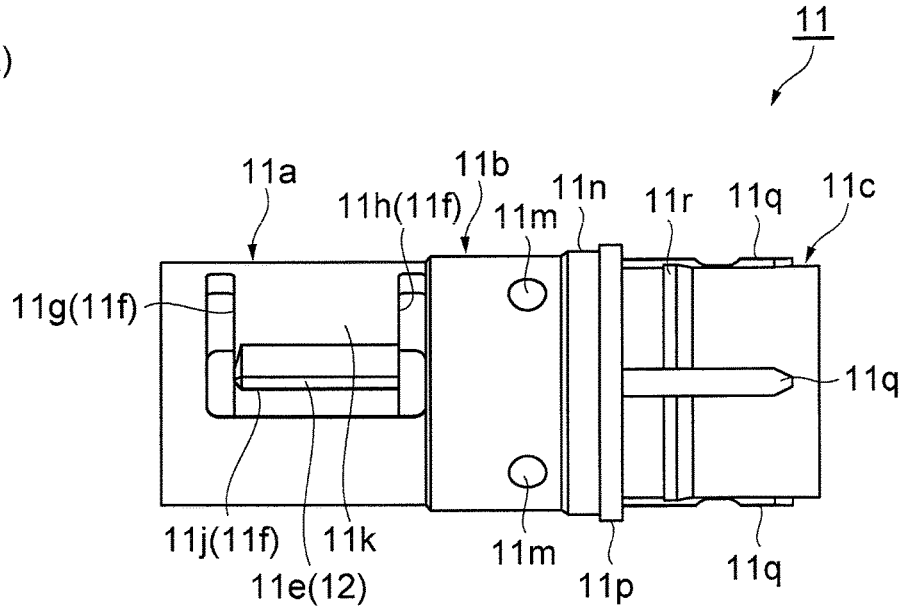
FIG. 9A is a side view illustrating an middle tube.
FIG. 9B is a vertical cross-sectional view illustrating the middle tube.
Figure 9:
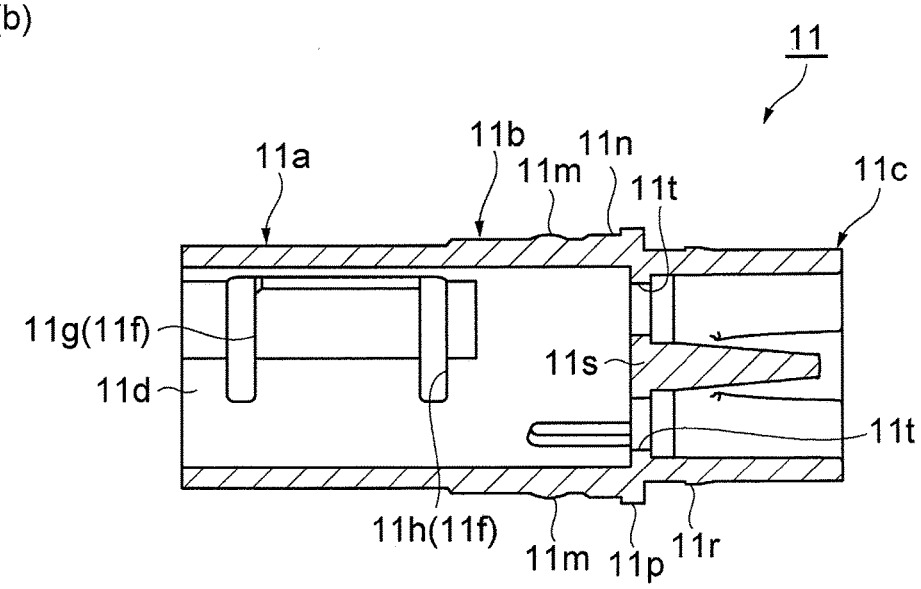

Although the embodiments of the present disclosure have been described above, the present disclosure is not limited to the embodiments described above, and variations may be made without departing from the gist described in the respective claims or applications to other items may be performed. That is, the configuration of the respective components constituting the feeding pencil 100 can be appropriately changed without departing from the above-described gist For example, as illustrated in FIG. 8 to FIG. 9B, the above-described embodiment describes the example where the elastic projecting parts 11*e* in the middle tube 11 and the concave-convex part 2*f* on the leading tube 2 constitute the ratchet mechanism 12 and the projections 11*m*, which are disposed on the outer surface of the middle tube 11, and the annular convex parts 2*g*, which are disposed on the inner surface of the leading tube 2, are removably engaged in the axial direction. However, as a feeding pencil according to a modification, annular convex parts removably engaging with the elastic projecting parts 11*e*, which constitute the ratchet mechanism 12, in the axial direction may be disposed on the inner surface of the leading tube 2.

That is, the feeding pencil according to this modification includes the tubular main body 3, the leading tube 2, and the middle tube 11. The leading tube 2 is engaged with the main body 3 to be relatively rotatable. The middle tube 11 has the tube portions (the front tube 11*a* and the center tube 11*b*)

inserted into the inside of the rear side of the leading tube 2. The middle tube 11 is positioned between the leading tube 2 and the main body 3. The middle tube 11 is engaged to the leading tube 2 to be relatively rotatable. The relative rotation between the leading tube 2 and the main body 3 in the one direction moves the drawing material M forward in the inside of the leading tube 2. The ratchet mechanism 12 allows the relative rotation between the leading tube 2 and the main body 3 in the one direction. The ratchet mechanism 12 regulates the relative rotation in the other direction opposite from the one direction. The ratchet mechanism 12 includes the elastic projecting parts 11*e* and the concave-convex part 2*f*. The elastic projecting parts 11*e* project from the outer surface on the tube portion of the middle tube 11 and have the elasticity in the radial direction. The concave-convex part 2*f* is disposed on the inner surface of the leading tube 2. The concave-convex part 2*f* engages with the elastic projecting parts 11*e* to be movable in the axial direction and rotatable. The elastic projecting parts 11*e* removably engage with the annular convex part disposed at the inner surface on the leading tube 2 in the axial direction.

As described above, with the feeding pencil according to this modification, the elastic projecting parts 11*e* removably engage with the annular convex part disposed on the inner surface of the leading tube 2 in the axial direction. Accordingly, the elastic projecting parts 11*e*, which constitute the ratchet mechanism 12, removably engage with the annular convex parts on the inner surface of the leading tube 2. Thus, the elastic projecting parts 11*e* also have the function to be removably attachable. Thus, the elastic projecting parts 11*e* can have the function to be removably attachable. This allows eliminating the projections 11*m*.

The above-described embodiment describes the example where the annular convex parts 2*g*, the annular concave parts 2*h*, which are positioned on the front side of the annular convex parts 2*g*, and the annular concave parts 2*j*, which are positioned on the rear side of the annular convex parts 2*g*, are disposed on the inner surface of the leading tube 2. However, the annular concave parts 2*h* or the annular concave parts 2*j* can be omitted. That is, at least any one of the front side of the annular convex parts 2*g* and the rear side of the annular convex parts 2*g* can be formed into flat surfaces.

The above-described embodiment describes the example where the projections 11*m*, which are disposed on the outer surface of the middle tube 11, and the annular convex parts 2*g*, which are disposed on the inner surface of the leading tube 2, removably engage with one another in the axial direction. However, aspects of the shape and the arrangement of the projections 11*m* on the middle tube 11 and the annular convex parts 2*g* on the leading tube 2 are not limited to the above-described example. Further, instead of the projections 11*m* and the annular convex parts 2*g*, an annular convex part may be formed on the outer surface of the middle tube 11 and a protrusion may be formed on the inner surface of the leading tube 2. This annular convex part on the outer surface of the middle tube 11 may removably engage with the protrusion on the inner surface of the leading tube 2 in the axial direction. The above-described embodiment describes the example where the middle tube 11 includes the front tube 11*a* and the center tube 11*b*, however, appropriately changing the shape of the middle tube is also possible.

As illustrated in FIG. 11A and FIG. 11B, the above-described embodiment describes the example where providing the slits 6*d* to the holding member 6 increases the radial elastic force at the front end of the holding member 6. This holding member 6 may further include an elastic part that provides an external elastic force to the movable body 5, which is internally held by the holding member 6. Specifically, for example, a circumferentially-extending annular concave part may be formed between the plurality of slits 6*d* on the outer surface of the holding member 6, and an O-ring, which is an elastic body, may be entered into this annular concave part. In this case, entering the O-ring into the annular concave part tightens the movable body 5 held by the holding member 6 inwardly in the radial direction, thus further reliably preventing the movable body 5 from exiting from the holding member 6. That is, the elastic force outwardly in the radial direction by the elastic part ensures further increasing the holding force by the holding member 6.

The above-described embodiment describes the example where the protrusions 6*f* on the holding member 6 are formed in the spiral pattern on the inner surface 6*e* of the holding member 6. However, the aspects of the shape and the arrangement of the protrusions formed on the inner surface 6*e* of the holding member 6 are not limited to the above-described example. For example, protrusions in a pattern other than the spiral pattern may be disposed at a plurality of positions along the axial direction on the inner surface 6*e* of the holding member 6. In this case as well, the plurality of protrusions disposed along the axial direction each press the male screw 5*a* of the movable body 5 outwardly in the radial direction. This ensures causing the male screw 5*a* to be less likely to exit from the holding member 6. Thus, the plurality of protrusions disposed along the axial direction can increase strength against the exit of the male screw 5*a*.

Further, the above-described embodiment describes the example where the protrusions 6*f* on the holding member 6 are disposed at the three positions along the axial direction on the inner surface 6*e* of the holding member 6. However, the protrusion(s) 6*f* may be disposed at one position, two positions, or four positions or more along the axial direction.

As illustrated in FIG. 13B, the above-described embodiment describes the example where the protrusions 1*b* are disposed at four uniformly arranged positions in the circumferential direction on the front of the female screw 1*a* in the inner surface of the pipe member 1. These protrusions 1*b* prevent the drawing material M loaded to the pipe member 1 from exiting. However, measures to prevent the drawing material M from exiting may be taken with members other than the protrusions 1*b*. For example, instead of the protrusions 1*b*, measures to increase a friction coefficient may be taken on the inner surface of the pipe member 1. Alternatively, the measures to prevent the exit may be taken by forming the inner surface of the pipe member 1 into a non-circular shape such as a polygonal shape.

The above-described embodiment describes the feeding pencil 100, a variety pencil, which includes the drawing materials M1 to M4 with colors different from one another. However, the feeding pencil may include drawing materials with thicknesses different from one another. Additionally, the feeding pencil may include a plurality of drawing materials whose materials or applications are different from one another. The number of the drawing materials is not limited to four but may be two, three, or five or more.

Further, the feeding pencil according to the present disclosure may not be a variety pencil. That is, the feeding pencil according to the present disclosure may include each one of the drawing material, the pipe member, the movable body, and the holding member.

What is claimed is:

1. A feeding pencil comprising:

a tubular main body;

a leading tube configured to be rotatably engaged with the main body;

a middle tube having a tube portion configured to be inserted into a rear side portion of the leading tube, the middle tube being positioned between the leading tube and the main body, the middle tube being configured to be rotatably engaged with the leading tube, the relative rotation between the leading tube and the main body in one direction moving a drawing material forward inside of the leading tube; and a ratchet mechanism configured to allow the relative rotation between the leading tube and the main body in one direction, the ratchet mechanism being configured to regulate the relative rotation in other direction opposite from the one direction, wherein:

the ratchet mechanism includes an elastic projecting part and a concave-convex part, the elastic projecting part projecting from an outer surface on the tube portion, the elastic projecting part having elasticity in a radial direction, the concave-convex part being disposed on an inner surface of the leading tube, the concave-convex part being configured to engage with the elastic projecting part to be movable in an axial direction and rotatable, and a projection disposed at any one of the outer surface of the tube portion and the inner surface of the leading tube is configured to removably engage with an annular convex part disposed at another in the axial direction.

2. The feeding pencil according to claim 1, wherein:

the plurality of drawing materials are stored in the leading tube, a plurality of sliding parts coupled to the plurality of drawing materials respectively are disposed, the plurality of sliding parts being slidable with respect to the main body by a predetermined amount, and one arbitrary sliding part, out of the plurality of sliding parts, moves forward by a predetermined amount with respect to the main body, whereby the drawing material coupled with the one arbitrary sliding part is exposed from the leading tube, and in this state, the leading tube and the main body are relatively rotated in one direction, which allows the drawing material to move forward.

* * * * *